United States Patent [19]

Shimizu

[11] Patent Number: 4,806,269

[45] Date of Patent: Feb. 21, 1989

[54] WASTE OIL PROCESSING SUBSTANCE

[75] Inventor: Kazuo Shimizu, Kasukabe, Japan

[73] Assignee: 501 Mimasu Oil Chemical Co., Ltd., Tokyo, Japan

[21] Appl. No.: 56,818

[22] Filed: Jun. 2, 1987

[30] Foreign Application Priority Data

Jun. 14, 1986 [JP] Japan ..... 61-138777

[51] Int. Cl.[4] ..... C11D 13/30; C11D 9/14

[52] U.S. Cl. ..... 252/369; 252/109; 252/111; 252/367; 252/DIG. 5; 252/DIG. 16

[58] Field of Search ..... 252/117, 108, 109, 367, 252/368, 369, 370

[56] References Cited

U.S. PATENT DOCUMENTS 4,497,667 2/1985 Vashi ..... 148/6.15 R
4,556,504 12/1985 Rok ..... 252/135
4,560,492 12/1985 Curry ..... 252/110
4,620,935 11/1986 Baxter ..... 252/99

FOREIGN PATENT DOCUMENTS 2154599 9/1985 United Kingdom .

*Primary Examiner*—Paul Lieberman
*Assistant Examiner*—Kathleen Markowski
*Attorney, Agent, or Firm*—Wegner & Bretschneider

[57] ABSTRACT

The substance of the present invention which contains alkali metal carbonate or alkali metal silicate, alkali metal-organic acid salt, a surface-active agent, alkali metal hydroxide and water is capable of converting waste cooking oil into soap which can be used for washing purposes. The substance contains a minimum amount of or no strong alkali substances and is therefore quite safe for home use. Thus, waste cooking oil may be recycled for useful purposes and contamination of sewage with waste cooking oil can be prevented.

4 Claims, No Drawings

WASTE OIL PROCESSING SUBSTANCE

TECHNICAL FIELD

The present invention relates to a substance for processing waste cooking oil (which may include oil and fat from either vegetable or animal sources) and in particular to a substance which allows waste cooking oil to be converted into soap or detergent (including substances which may be considered to be soap in terms of chemical structure but which would not be considered to be soap in terms of such physical properties as appearance, consistency, etc.) so that the waste cooking oil can thereby be recycled for reuse as detergent.

BACKGROUND OF THE INVENTION

In the methods of processing waste cooking oil proposed in Japanese patent laid open publications Nos. 60-44597 and 59-81398, waste cooking oil is absorbed into inorganic non-water-soluble substances such as activated clay, montmorillonite, sepiolite, bentonite, calcite, attapulgite, clay and so on and is then filtered for reuse. According to other known methods of processing waste cooking oil, enzyme may be applied to the waste cooking oil, or the waste cooking oil may be chemically reduced or absorbed into fibril media such as paper, non-woven fabric, rayon fibers and so on.

Japanese patent laid open publication No. 55-106298 discloses a method in which waste cooking oil is solidified by means of a certain higher fatty acid to form a gel which can be readily disposed of.

In the above mentioned prior art methods of processing waste cooking oil, since the waste cooking oil is either recycled in a form which may suitable for human consumption or is simply discarded, it cannot be fully utilized, there is therefore a demand for a method or a substance which will allow waste cooking oil to be recycled in the form of a reuseable substance.

It has been previously known that soap can be produced as a result of a (saponification) reaction between alkali metal hydroxide (such as sodium hydroxide and potassium hydroxide) and animal fat or vegetable oil. However, such strong alkaline chemical compounds are not suitable for use at home. Alkali metal hydroxide is highly reactive with carbon dioxide and humidity in the air and could be dangerous because the reactions are often extremely violent.

BRIEF SUMMARY OF THE INVENTION

In view of such problems of the prior art, a primary object of the present invention is to provide a substance which is capable of producing soap from waste cooking oil with a minimum amount (such as 5% or less) of or without any alkali metal hydroxide. In this way, not only can the waste cooking oil be reused as soap and economic advantage obtained but also contamination of sewage with waste cooking oil can be prevented. In addition, allowing the user to produce soap from waste cooking oil will serve a beneficial educational purpose.

Instead of containing any irritant or corrosive components as a major component, the substance provided by the present invention contains only mild chemical compounds which an ordinary consumer can safely handle.

According to the present invention, such objects are accomplished by providing a substance for processing waste cooking oil, comprising: at least either one of alkali metal carbonate and alkali metal silicate; at least 5wt% of alkali metal-organic acid salt; at least 5wt% of a surface-active agent; no more than 20wt% of alkali metal hydroxide; and no more than 10wt% of water.

Some of the individual components contained in the substance of the present invention have been previously known to be useable for saponification. However, there has been no attempt to combine them with waste cooking oil. By mixing the substance of the present invention with waste cooking oil and water and heating the mixture, one can obtain soap in a short time and use it for washing purposes.

According to a certain aspect of the present invention, the alkali metal carbonate is a combination selected from a group consisting of sodium carbonate, potassium carbonate, sodium sesquicarbonate and sodium bicarbonate; the alkali metal silicate is a combination selected from a group consisting of sodium silicate, potassium silicate and sodium aluminosilicate; the surface-active agent is a combination selected from a group consisting of polyoxyethylene-alkyl($C_{12}$ to $C_{18}$)ether, linear alkanolamide fatty acid, polyoxyethylenealkylphenol, alkyldimethyl-amineoxide, sorbitan fatty acid ester, ethyleneglycol-alkylate, glycerolalkylate, polyoxyethylene-alkanolamide fatty acid, polyethyleneglycol and polyoxyethylene-polyoxypropylene block polymer.

According to another aspect of the present invention, at least either one of the alkali metal carbonate and the metal silicate contains alkali metal phosphate; the organic acid salt is a combination selected from a group containing citrate, malate, polyacrylate, polymalate, tartrate, succinate, nitrileacetate, gluconate, glycolate, ethylenediaminetetraacetate and diethylenetriaminepentaacetate; the content of the surface-active agent is 5wt% to 35wt%; the content of the alkali metal hydroxide is no more than 5wt%; and the water content is no more than 10wt%.

According to yet another aspect of the present invention, the alkali metal carbonate is 10wt% or more, the alkali metal silicate is 5wt% or more, the organic acid salt is 3wt% to 50wt%, the surface active agent is 5wt% to 35wt%, the alkali metal hydroxide is 5wt% or less, and the water content represents from 3wt% to 10wt% of the total.

The carbonates which can be used in the substance of the present invention include sodium carbonate, potassium carbonate, ammonium carbonate, lithium carbonate, sodium sesquicarbonate, sodium bicarbonate, etc., these compounds previously having been known to be useable as alkali agents for saponification.

The silicates which can be used in the substance of the present invention include sodium silicate, potassium silicate, sodium orthosilicate, sodium metasilicate, sodium silicofluoride, sodium aluminosilicate (so-called synthetic zeolite), etc. In particular, sodium metasilicate is preferred because of its stability and water solubility.

The phosphates which can be used in the substance of the present invention include sodium tripolyphosphate, sodium metaphosphate, sodium pyrophosphate, potassium pyrophosphsate, sodium tertiary phosphate, sodium secondary phosphate, sodium hexametaphosphate, ammonium phosphate, sodium superphosphate, etc. It is possible to do without any phosphate in implementing the present invention, but the use of phosphates is preferred because they represent a convenient way of providing a builder for the purpose of improving washing capability.

One of the features of the present invention is the use of organic salt which may be a carboxylate such as citrate, malate, succinate, tartrate, oxalate, gluconate, fumarate, acetate, propionate, lactate, adipate, glutarate, itaconate, maleinate, maleate and aconitate of sodium, potassium, ammonium or magnesium, as well as tetrasodium ethylene-diaminetetraacetate, disodium ethylenediamine-tetraacetate, sodium diethylenetriaminepentaacetate, sodium hydroxyethylenediaminetriacetate, sodium aminotrimethylenephosphate, sodium ethylendiamine-(tetra)methylenephosphonate, sodium nitrile-triacetate, homocopolymers of acrylic acid having CHR=CHCWH (R is either H or $CH_3$) as a monomer (such as those disclosed in Japanese patent publications Nos. 54-38122 and 58-27320) and organic builders disclosed in "Yukagaku (Oil Chemistry)", Vol. 29, No. 10 (1980), The content of such organic acid salts is preferably 5% or more. If the content of organic acid salt is less than 5%, the saponification rate of the waste cooking oil is reduced and it takes longer (for instance more than 60 minutes) to complete saponification. Furthermore, formation of soap scum presents another problem if the organic acid salt content is less than 5%.

The substance of the present invention contains sodium hydroxide or potassium hydroxide in an amount of less than 20%, preferably less than 5%. 20% is a critical value since the substance will be deliquescene, skin irritating and highly reactive, thereby making it unsuitable for handling, if the content of strong alkali such as sodium hydroxide and potassium hydroxide exceeds 20%. 5% is another critical value since the substance will fall under the purview of certain regulatory laws if the content of strong alkali exceeds 5%. The substance of the present invention desirably contains alkali metal hydroxide in an amount of less than 5% but, in an extreme case, may contain no alkali metal hydroxide at all. A content of less than 5%, for instance from 2 to 3%, of alkali hydroxide is desirable in order to ensure satisfactory saponification of waste cooking oil.

The water content is preferred to be less than 10%, either in the form of crystal water or water as it is. Addition of water to the substance promotes precipitation of sodium ions and is therefore helpful in ensuring satisfactory saponification of waste cooking oil. The water content is limited to 10% or less because an excessive water content would not only lead to the substance becoming sticky and unstable but also causes hydrolysis to take place between the surface-active agent and the alkali compounds.

A surface-active agent of either anionic or nonionic type must be included in the substance in an amount of 5% or more. The content of the surface-active agent is preferably no less than 5% because the surface-active agent contributes to the saponification of waste cooking oil as well as to promoting the formation of suds and suppressing the formation of scum. The surface-active agent content should preferably be from 5% to 40%. On the other hand, if the content of the surface-active agent is excessive, the consistency of the produced soap and its stability will be lost, in particular during a saponification process undertaken at high temperatures. (This tendency becomes greater as the ratio of the surface-active agent content to the content of alkali metal salt increases.)

Typical surface-active agents which can be used in the substance of the present invention include the following components; nonionic surface-active agents such as polyoxyethylenealkylether, polyoxyethylenealkylphenolether, alkanolamide linear fatty acid, polyoxyethylene fatty acid ester, polyoxyethylenealkanolamide fatty acid, sucrose fatty acid ester, alkyldimethylamineoxide, polyoxyethylenedialkal-ether, polypropyreneglycolethylene-oxide, etc., and anionic surface-active agents such as linear alkylbenzenesulfonates, alkylsulfates, alkylethersulfates, alkylsulfonates, alpha-olefinsulfonates, alpha-sulfofatty acid salts, dialkylsulfosuccinates, monoalkylphosphates, acylglutamate, polyoxyethylenealkyldiphenylsulfonates, linear fatty acid salts, etc. Generally speaking, nonionic surface-active agents are superior over anionic surface-active agents in terms of stability, emulsification capability and separation capability.

The substance of the present invention may optionally contain the following components for the purposes of adding fragrance, deodorizing capabilities, and abrasive properties and of promoting emulsification.

For the purpose of providing the substance with fragrance, the substance may contain vegetable essences, synthetic and natural perfume bases, vegetable and fruit juices, etc.

For the purpose of providing deodorization capabilities, the substance of the present invention may contain activated clay, acid clay, zeolite, sepiolite, activated charcoal, molecular sieve, attapulgite, zinc oxide, magnesium hydroxide, kutnahorite, kalinite, chloramine T, chlorinated sodiumisocyanurate, thiourea, ethyl urea, benzotriazole, bonzthiazuron, alpha-tocopherol, hinokithiol, isopropylmethylphenol, etc.

For the purpose of adding abrasive properties to the substance, the substance may contain calcite, celite, silica, mica, titianium white, clay, bentonite, muscovite (white mica), synthetic resin beads, polystyrene beads, fine particles of almond, fine particles of walnut, cellulose powder, glass wool powder, boron nitride, silicon carbide, corundum, emery, etc.

For the purpose of promoting saponification of the waste cooking oil, the substance of the present invention may contain alkanolamines, ammonium compounds, boron, various alkali compounds, fluorescent agents, enzymes (such as lipase, amylase and protease), coloring agents, bluing agents, etc. DETAILED DESCRIPTION OF THE PREFERRED EMBODIMENTS Concrete embodiments of the present invention are described in the following:

EXAMPLE 1

A sample of soap was produced from 500 grams of waste cooking oily by using the substance of the present invention having the following composition:

| | |
|---|---|
| Sodium carbonate | 35 wt % |
| Sodium metasilicate | 35 wt % |
| Tetrasodium ethylenediaminetetraacetate | 7 wt % |
| Sodium gluconate | 5 wt % |
| Polyoxyethylenelaurylether | 11 wt % |
| Coconut oil fatty acid monoethanolamide | 4 wt % |
| Sodium hydroxide | 3 wt % |

250 grams of this substance and 100 grams of water were added to the waste cooking oil contained in a three-liter stainless steel container and boiled for 30 minutes over a direct flame. The viscous soap thus produced was cooled in water and then placed in a refrigerator at 5+/−1.5° C. temperature for 24 hours.

The properties of the thus obtained soap were evaluated in the following manner:

Suds Generation 400 mililiters of 1.5wt% water solutions of the following three kinds of soap were prepared and each water solution was held in a measuring cylinder 15 mm in diameter. After the measuring cylinder had been vigorously shaken, the height of the suds generated was measured for each soap with the following results:

| | |
|---|---|
| Soap of the present invention | 26 mm |
| Commercially sold soap | 28 mm |
| Commercially sold LAS type kitchen detergent | 22 mm |

Suds Lasting 15 grams of the soap of the present invention and 25 grams of commercially sold laundry detergent (LAS content 20%) were used in a washing machine having a water capacity of 30 liters for 15 minutes and measurements were taken to determine how soon the suds disappeared. For comparison, a laundry detergent A capable of speeding up rinsing time and a powder soap B were used in a similar fashion and the following results were obtained:

| | |
|---|---|
| Soap of the present invention | 4 min. 40 sec. |
| Laundry detergent A | 4 min. 55 sec. |
| Powder soap B | slightly less than 4 minutes |

Washing Capabilities

A smearing agent of the following composition was evenly applied on a 10×10 cm piece of cotton fabric and the smear was allowed to disperse into the fabric by being placed at 35° C. in a temperature regulated tank for 24 hours.

| | |
|---|---|
| Cholesterol | 0.25 wt % |
| Oleic acid | 0.44 wt % |
| Kaolin | 42.00 wt % |
| Carbon black | 0.03 wt % |
| Water | 12.00 wt % |
| Soil (Kanto loam) | balance |

The soap was applied to the smeared fabric and machine washed for 120, 60 and 30 seconds.

For comparison, a commercially sold Marseilles soap containing 20% sodium silicate, a commercially sold kitchen soap (soap content 98%) and liquid kitchen detergent (non-ionic higher alcohol) were used in a similar fashion.

The fabric samples washed with the different soaps for different durations were rinsed with water and allowed to dry naturally. The following results were obtained by means of visual tests:

| Time (sec.) | 120 | 60 | 30 |
|---|---|---|---|
| Soap of the present invention | good | fair | fair |
| Marseilles soap | good | fair | fair |
| Kitchen soap | fair | poor | poor |
| Kitchen detergent | fair | fair | poor |

EXAMPLE 2

Samples of 500 grams each of waste cooking oil (soy bean oil) were processed by utilizing the following substances:

| | *2 | 1 | 2 | 3 | 4 | 5 | 6 |
|---|---|---|---|---|---|---|---|
| Sodium carbonate | 30 | — | 80 | 80 | 65 | 47 | 56 |
| Sodium silicate | 40 | — | 20 | 10 | 30 | 34 | 30 |
| EDTA | 5 | — | — | — | — | — | 2 |
| GLNA | 5 | — | — | — | — | — | 2 |
| Sodium citrate | — | — | — | — | — | — | 2 |
| NaOH | 4 | 100 | — | 10 | 5 | 5 | 2 |
| KOH | — | — | — | — | — | — | 3 |
| Activated clay | 2 | — | — | — | — | 5 | — |
| Sepiolite | — | — | — | — | — | 5 | — |
| SAA-A | 10 | — | — | — | — | 4 | — |
| SAA-B | 4 | — | — | — | — | — | 3 |

*2: substance of the present invention 1 through 6: soaps for comparison
EDTA: tetra sodium ethylenediaminetetraacetate
GLNA: sodium gluconate
SAA-A: polyoxyethylene(Eo9)laurylether SAA-B: monoethanolamide coconut oil fatty acid with 5 mol Eo added thereto.

250 grams of each substance and 200 mililiters of water were added to 500 grams of waste kitchen oil contained in a 3-liter stainless steel container and the mixture was boiled for 30 minutes over a direct gas flame. Then, the state of solidification, the production of suds and the skin irritation tendency of each soap were tested, the following results being obtained.

| | solidification | | suds | skin | |
|---|---|---|---|---|---|
| | time min. | reaction | formation mm | irritation fa % | impression |
| 1 | 25 | abrupt bumping | 24 | 0.50 | −4 |
| 2 | 60> | brisk stirring necessary | 12 | 0.02 | −2 |
| 3 | 60> | brisk stirring necessary | 5 | 0.18 | +2 |
| 4 | 60> | brisk stirring necessary | 10 | 0.03 | +3 |
| 5 | 50 | smooth | 20 | 0.05 | +3 |
| 6 | 60> | smooth | 18 | 0.07 | +2 |
| *2 | 25 | smooth | 24 | 0.03 | +2 |

Note
*2 Soap made by the substance of the present invention Skin irritation was evaluated in terms of free alkali (fa %) and the impression was evaluated by five monitors who used the soaps for hand washing (ten times at 40° C.) by comparing each soap with a commercially sold soap. Positive values in ascending order were given for impressions of better quality, negative values in descending order for impressions of poorer quality, and zero in the case of no difference in comparison.

EXAMPLE 3

| | *3 | *4 | *5 | 7 | 8 | 9 | 10 | 11 |
|---|---|---|---|---|---|---|---|---|
| Sodium carbonate | 70 | — | 25 | 30 | 52 | 5 | 22 | 50 |
| Metasilica | — | 19 | — | 40 | 10 | — | — | — |
| Orthosilica | — | 34 | 5 | 10 | 10 | — | 10 | 10 |
| EDTA-4Na | 5 | 10 | 5 | 10 | 10 | 69 | 2 | 5 |
| NTA | 8 | 2 | 0 | 2 | 2 | 10 | 2 | 0 |
| NaOH | 4 | 18 | 0 | 3 | 8 | 3 | 4 | 22 |
| Sepiolite | 5 | — | — | — | 3 | 3 | 5 | — |
| Water | 5 | 3 | 4 | 5 | 5 | 5 | 5 | 5 |
| POA | 2 | 6 | 15 | — | — | 3 | 40 | 6 |
| SA | 3 | 8 | 15 | — | — | 2 | 10 | 2 |
| STPP | — | — | 20 | — | — | — | — | — |

note
*3, *4 and *5: Substances of the present invention
NTA: Nitrilotriacetic acid
POA: polyoxyethaleneoleyl (Eo15 mol) ether
SA: sorbitansesquioleate

| | *3 | *4 | *5 | 7 | 8 | 9 | 10 | 11 |
|---|---|---|---|---|---|---|---|---|
| consistency (25 min.) | Sld | Sld | Sld | Spr | Pst | Pst | Pst | Sld |
| suds formation (mm) | 32 | 28 | 25 | 12 | 8 | 15 | 18 | 22 |
| long-term state | NC | NC | NC | NC | NS | PS | SD | SD |

note
*3, *4 and *5 Soaps made by the substances of the present invention
Sld: Solid
Spr: Separation
Pst: Paste
NC: No change
NS: No sticking
PS: Paste condition
SD: Solidified condition

What we claim is:

1. A process for the conversion of waste cooking oil to a soap or detergent comprising contacting waste cooking oil with a composition comprising at least one of an alkali metal carbonate or an alkali metal silicate, wherein the alkali metal carbonate is present in amounts of 10% by weight or greater, and the alkali metal silicate is present in amounts of 5% by weight or greater, at least 5 wt% of alkali metal-organic acid salt;

at least 5 wt% of a non-ionic surface-active agent;

1 to 20 wt% of alkali metal hydroxide; and 1 to 10 wt% water; and adding water and heating for an amount of time sufficient to form a soap or detergent composition.

2. A process for the conversion of waste cooking oil to soap or detergent as defined in claim 1, wherein:

the alkali metal carbonate is selected from the group consisting of sodium carbonate, potassium carbonate, sodium sesquicarbonate and sodium carbonate and mixtures thereof;

the alkali metal silicate is selected from the group consisting of sodium silicate, potassium silicate, sodium metasilicate, sodium orthosilicate, sodium aluminosilicate and mixtures thereof; and the surface-active agent is selected from the group consisting of polyoxyethylenealkyl ($C_{12}$ to $C_{18}$) ether, linear alkanolamine fatty acid, polyoxyethylenealkylphenol, alkyldimethylamineoxide, sorbitan fatty acid ester, ethyleneglycolalkylate, glycerolalkylate, polyoxyethylenealkanolamide fatty acid, polyethyleneglycol, polyoxyethylenepolyoxypropylene block polymer and mixtures thereof.

3. A process for the conversion of waste cooking oil to soap or detergent as defined in claim 1, wherein:

at least one of the alkali metal carbonate and the alkali metal silicate contains up to 20 wt% alkali metal phosphate;

the organic salt selected from the group consisting of citrate, malate, polyacrylate, polymalate, tartrate, succinate, nitrileacetate, gluconate, glycolate, ethylenediaminetetraacetate and diethylenetriaminepentaacetate;

the content of the surface-active agent is 5 wt% to 35 wt%;

the content of the alkali metal hydroxide is 1 to 5 wt%; and the water content of the composition added to the waste cooking oil is 1 to 10 wt%.

4. A process for the conversion of waste cooking oil to soap or detergent as defined in claim 1, wherein the alkali metal carbonate when present is in amounts of 10 wt% or more; the alkali metal silicate is present in amounts of 5 wt% or more, the organic acid salt is present in amounts of 3 wt% to 50 wt%, the surface-active agent is present in amounts of from 5 to 50 wt%, the alkali metal hydroxide content is 5 wt% or less, and the water content of the composition added to the waste cooking oil is between 3 and 10 wt%.

* * * * *